US009874000B2

(12) United States Patent
Heiler et al.

(10) Patent No.: US 9,874,000 B2
(45) Date of Patent: Jan. 23, 2018

(54) SUBSURFACE MINING VEHICLE AND METHOD FOR COLLECTING MINERAL DEPOSITS FROM A SEA BED AT GREAT DEPTHS AND TRANSPORTING SAID DEPOSITS TO A FLOATING VESSEL

(71) Applicant: OceanflORE B.V., Kinderdijk (NL)

(72) Inventors: Johan Heiler, Zoersel (BE); Pieter Abraham Lucieer, Rotterdam (NL); Kris De Bruyne, Deurne (BE); Harmen Derk Stoffers, Breda (NL)

(73) Assignee: Global Sea Mineral Resources (GSR) N.V., Ostend (BE)

( * ) Notice: Subject to any disclaimer, the term of this patent is extended or adjusted under 35 U.S.C. 154(b) by 0 days.

(21) Appl. No.: 15/100,735

(22) PCT Filed: Dec. 2, 2014

(86) PCT No.: PCT/EP2014/076198

§ 371 (c)(1),
(2) Date: Jun. 1, 2016

(87) PCT Pub. No.: WO2015/082445

PCT Pub. Date: Jun. 11, 2015

(65) Prior Publication Data

US 2016/0298312 A1 Oct. 13, 2016

(30) Foreign Application Priority Data

Dec. 2, 2013 (NL) ..... 2011880
Apr. 7, 2014 (NL) ..... 2012579

(51) Int. Cl.
*E02F 3/88* (2006.01)
*E02F 3/90* (2006.01)
(Continued)

(52) U.S. Cl.
CPC ..... *E02F 3/8866* (2013.01); *B63G 8/001* (2013.01); *E02F 3/905* (2013.01); *E02F 7/005* (2013.01); *E02F 9/003* (2013.01); *E21C 50/00* (2013.01)

(58) Field of Classification Search
CPC ..... E02F 3/8866; E02F 3/8858; E02F 3/90; E02F 3/907; E02F 3/92; E02F 3/9206;
(Continued)

(56) References Cited

U.S. PATENT DOCUMENTS 4,232,903 A 11/1980 Welling et al.
4,334,370 A * 6/1982 Holzenberger ..... F04D 15/0066 37/195

(Continued)

FOREIGN PATENT DOCUMENTS

WO 2012134275 A2 10/2012
WO 2012158028 A1 11/2012

*Primary Examiner* — Robert E Pezzuto
(74) *Attorney, Agent, or Firm* — The Webb Law Firm

(57) ABSTRACT

A subsurface mining vehicle and a method are used for collecting mineral deposits from a sea bed at great depths and transporting the deposits to a floating vessel. The vehicle has a load-bearing structure having an arrangement for advancing the vehicle on the sea bed, and a pick-up unit for the deposits. A lifting frame is also provided and at one end equipped with a connector to connect to a suspension cable provided between the floating vessel and the vehicle. The lifting frame is at another end connected to the load-bearing structure by a hinged connection, that is actuated by an actuator such that the angular position of the load-bearing structure can be fixed in a number of different angular positions relative to the lifting frame while the vehicle is suspended. The lifting frame allows to launch and position the submarine vehicle in a controlled manner.

19 Claims, 5 Drawing Sheets

(51) Int. Cl.

| | |
|---|---|
| ***E02F 7/00*** | (2006.01) |
| ***E02F 9/00*** | (2006.01) |
| ***E21C 50/00*** | (2006.01) |
| ***B63G 8/00*** | (2006.01) |

(58) Field of Classification Search

CPC . E02F 7/023; E02F 7/065; E02F 7/005; E02F 3/905; E21C 50/00

USPC ..... 37/195, 308, 309, 310, 312, 314, 317, 37/320, 313; 299/8; 417/54, 108

See application file for complete search history.

(56) References Cited

U.S. PATENT DOCUMENTS

| | | | | |
|---|---|---|---|---|
| 4,391,468 | A * | 7/1983 | Funk | E02F 3/90 299/8 |
| 4,685,742 | A * | 8/1987 | Moreau | E02F 3/8858 299/8 |
| 9,334,734 | B2 * | 5/2016 | Hong | E21C 50/00 |
| 9,574,445 | B2 * | 2/2017 | Yeu | E21C 50/00 |

* cited by examiner

SUBSURFACE MINING VEHICLE AND METHOD FOR COLLECTING MINERAL DEPOSITS FROM A SEA BED AT GREAT DEPTHS AND TRANSPORTING SAID DEPOSITS TO A FLOATING VESSEL

CROSS-REFERENCE TO RELATED APPLICATIONS

This application is the United States national phase of International Application No. PCT/EP2014/076198 filed Dec. 2, 2014, and claims priority to Netherlands Patent Application Nos. 2011880 and 2012579 filed Dec. 2, 2013 and Apr. 7, 2014, respectively, the disclosures of which are hereby incorporated in their entirety by reference.

BACKGROUND OF THE INVENTION

Field of the Invention

The present invention relates to a subsurface mining vehicle for collecting mineral deposits from a sea bed at great depths and transporting them to a floating vessel. The invention further relates to a method for collecting mineral deposits from a sea bed at great depths and transporting them to a floating vessel.

Description of Related Art

Deep sea mining involves collecting mineral deposits, such as polymetallic nodules, diamonds, gold, and rare soils from (below) the sea floor 4,000-6,000 m. Polymetallic nodules may for instance comprise nickel, copper, cobalt and manganese nodules. In deep sea mining, the sea floor may be a distance of up to 5000 m and more away from the sea surface, and developing equipment for deep sea mining imposes many challenges.

Deep sea mining vessels need to bring subsurface mining equipment to the sea floor and recover the same from the sea floor after termination of a mining operation. Typical vessels thereto comprise some type of launching and docking device that is operated from a docking well. Such docking well passes through and is enclosed by the vessel hull, and opens to the sea at its bottom side defining a so-called splash zone of the docking well. The docking well may be closable across the bottom by movable gates if desired. A deep sea mining vessel further typically comprises pumping equipment for bringing mined mineral deposits from the sea floor to a vessel storage hold through a transport pipe system. A riser string extends from the vessel to the mining equipment to convey the mined mineral nodules towards the sea surface. A lift system is usually operational in raising and launching the riser string.

U.S. Pat. No. 4,232,903 discloses a subsurface mining vehicle for collecting mineral deposits from a sea bed and transport said deposits to a floating vessel. The mining vehicle comprises a load-bearing structure provided with propelling means for advancing the vehicle on the sea bed. The vehicle is equipped with a pick-up unit and with a frame that is used to attach the vehicle to a towing cable. During deployment of the vehicle, the frame remains in a vertical position in line with the cables from which it is suspended. When the vehicle is resting on the sea floor, the frame is dropped over to a more horizontal drag or tow position.

WO 2012/134275 A2 discloses a mining or dredging vehicle. The vehicle can be suspended from cables and a riser to mine or dredge materials from a sea bottom. The vehicle comprises a sledge construction with a support surface, the orientation of which is adjustable by hydraulic cylinders relative to a frame of the vehicle. A suction height controller is provided to control the height of an excavating head and thereby switch between a 'sledge mode' and a 'gliding mode'. The vehicle is further provided with an adjustable suspension arranged to mechanically connect to a towing cable. The adjustable suspension allows controlling the angle under which the towing cable exerts a towing force on the vehicle during movement along the sea bed and to achieve a better trim control.

WO 2012/158028 A1 discloses a generally known suction dredging vessel, provided with a suction pipe, to which suction pipe is attached a remotely controlled mining or dredging vehicle. The connection is through a flexible riser.

In launching subsurface mining equipment, the maximum environmental circumstances are often limited to certain wave heights, and considerable time is lost while waiting for a weather window for deploying or recovering the equipment. Further, most damages to subsea mining equipment occur during launching and recovery. Given the size, complexity and cost of a mining vehicle, this is unacceptable.

The above described disadvantages occur to an even higher extent in launching and recovering subsurface mining equipment. Indeed, deep sea mining equipment preferably has a relatively low weight, which makes it difficult to control such equipment when suddenly contacting a moving mass of water. The risk for collision with parts of the vessel or other structures is high.

Therefore, an aim of the present invention is to provide a device and method for launching subsurface mining equipment into a water mass from a docking well of a floating vessel, and recover said equipment from the water mass in a more controlled manner.

BRIEF SUMMARY OF THE INVENTION

The invention thereto provides a subsurface mining vehicle for collecting mineral deposits from a sea bed at great depths and transporting said deposits to a floating vessel, the vehicle comprising a load-bearing structure provided with means for advancing the vehicle on the sea bed, and with a pick-up unit for the deposits, the vehicle further comprising a lifting frame that is at one end provided with a suspension connector to connect to a suspension means provided between the floating vessel and the vehicle, and at another end connected to the load-bearing structure by a hinged connection, that is actuated by actuating means such that the angular position of the load-bearing structure relative to the lifting frame can be fixed in different angular positions while the vehicle is suspended from the suspension means. According to the invention, the lifting frame and actuating means are adapted to change the angular position of the vehicle frame with respect to a cable from which the vehicle is suspended. By providing the vehicle in accordance with the invention with a lifting frame that allows to rotate the load-bearing structure around a substantially horizontal axis (an axis about parallel to the sea bed) and fixate it in substantially any angular position while it is hanging in a suspension cable, it becomes possible to launch and recover a mining vehicle in about any angular position, and preferably in a substantially vertical position. This has proven to increase the controllability of the launching and recovery operation.

A useful embodiment of the invention provides an embodiment of the device further comprising a connector for connecting to a deposit transporting system provided between the vehicle and the floating vessel.

In another embodiment of the invention, a device is provided wherein the lifting frame is equipped with transporting means for picked-up deposits, which transporting means is at one end provided with the connector and at another end connects to the pick-up device. The transporting means provided on the lifting frame may for instance comprise a rigid conveying tube that is attached to a frame member of the lifting frame, and connects with the deposit transporting system through the connector.

In an embodiment of the invention, a subsurface mining vehicle is provided wherein the actuating means comprise hydraulic cylinders extending between the frame and the load-bearing structure.

Yet another embodiment of the invention provides a subsurface mining vehicle wherein the vehicle has a center of gravity and the hinged connection is positioned such that a pivot line between the frame and the load-bearing structure runs substantially through the center of gravity when the vehicle is totally submerged. The wording 'substantially' in the context of the present application means within 1.5 m, more preferably within 1 m, and most preferably within 0.5 m.

According to another embodiment of the invention, a subsurface mining vehicle is provided comprising buoyancy means, preferably in the form of a plurality of buoyancy elements, most preferably arranged onto parts of the vehicle. Suitable buoyancy elements need to be able to withstand the high pressures at a sea bottom, preferably more than 500 bar.

Another embodiment of the invention provides a subsurface mining vehicle wherein the load-bearing structure and/or the lifting frame are substantially planar.

In a particular embodiment of the subsurface mining vehicle according to the invention, the load-bearing structure comprises a fork-shaped frame of longitudinal beam members that join in a root of the fork-shaped frame, and transverse beam members spanning the distance between the longitudinal beam members at a distance from the root of the fork-shaped frame.

A useful embodiment of the subsurface mining vehicle is characterized in that a transverse member is pivotally connected to the root of the fork-shaped frame.

Another embodiment of the subsurface mining vehicle according to the invention comprises at least one propelling means at each side of the vehicle.

The propelling means may be any means known in the art but in a preferred embodiment comprise a track assembly.

Another particularly useful embodiment of the subsurface mining vehicle according to the invention comprises a suspension connector for the suspension means that is adapted to allow free rotation of the vehicle when suspended from the suspension means around an axis parallel to a suspension means axis. Suitable suspension means comprise a suspension cable.

According to another embodiment of the invention, the suspension connector of the subsurface mining vehicle comprises a slewing ring that is attachable to the suspension means and comprises a turning gland.

The invention further relates to a method for collecting mineral deposits from a sea bed at great depths and transporting said deposits to a floating vessel. The method in accordance with the invention comprises the consecutive steps of providing a subsurface mining vehicle in accordance with the invention, connecting the lifting frame of said mining vehicle to a suspension cable provided between the floating vessel and the vehicle, lowering the vehicle towards a sea bed with the load-bearing structure in a first angular position, actuate the hinged connection between the lifting frame and the load-bearing structure to fixate the load-bearing structure in a second angular position that differs from the first angular position of the load-bearing structure relative to the lifting frame, position the vehicle on the sea bed and advance the vehicle on the sea bed to pick-up the mineral deposits.

The mining vehicle is in an embodiment connected to a deposit transporting system provided between the vehicle and a floating vessel. The deposit transporting system may be configured in accordance with any system known in the art and preferably comprises a riser string of interconnected rigid pipe sections, provided between the vehicle and the floating vessel.

A particularly preferred embodiment of the method is characterized in that the first angular position is parallel to the vertical direction. More preferably, the second angular position makes an angle of 90° C. or more with respect to the vertical direction.

In yet another embodiment of the method according to the invention, the second angular position makes an angle of more than 90° C. with respect to the vertical direction, such that the vehicle contacts the sea bed first with a rear end thereof.

BRIEF DESCRIPTION OF THE DRAWINGS

The invention will now be elucidated in more detail with reference to the accompanying figures, without otherwise being limited thereto. In the figures:

FIG. 6 is a perspective view of a; and

DETAILED DESCRIPTION OF THE PREFERRED EMBODIMENTS

Figure 1:
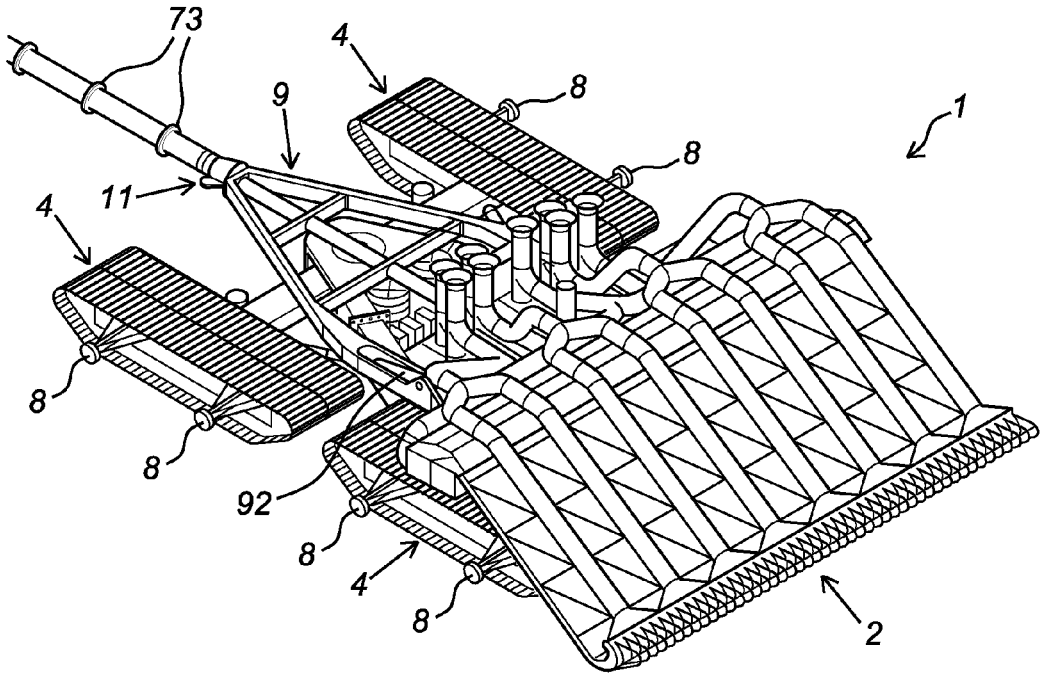
FIG. 1 is a perspective view of an embodiment of a subsurface mining vehicle of the present invention.

A general arrangement of an embodiment of a mining vehicle 1 that is readily launchable and recoverably by a docking device on a floating vessel is shown in FIG. 1. The mining vehicle 1 comprises on a front side thereof a collector 2. The "hydraulic" collector 2 of the embodiment shown is only one example of a suitable collector and other collectors may be used as well within the scope of the invention. The vehicle 1 further comprises a load-bearing structure 3 (see FIG. 3) provided with propelling means in the form of four track assemblies 4. A pair of track assemblies 4 moves independently from each other at one side of the vehicle 1, while another pair of track assemblies 4 moves at an opposite side of the vehicle 1. Rotating the track assemblies 4 will advance the vehicle 1 over a sea bed 5.

The load-bearing structure 3 further accommodates pumps, electrical equipment, hydraulic equipment and the like, and a hinged lifting frame 6 that connects the vehicle 1 to an interconnection hose assembly 7 of a riser. Four vehicle guiding brackets 8 are mounted on each side of the vehicle 1 and are intended to guide the vehicle 1 through guiding rails (not shown) provided in a docking device on a vessel during deployment. The brackets 8 are mounted on the foundations of the track assemblies 4, two per track assembly.

In order to reduce the submerged weight of the vehicle 1 and the soil bearing force of the track assemblies 4, is added in one embodiment in the form of pressure resistant buoyancy elements (not shown) with a density of around 300-700 kg/m3. The buoyancy is preferably equally distributed on the vehicle 1 and reduces the adherent water in the main load-bearing structure 3. The collector 2 on the front of the vehicle 1 may be neutrally compensated by buoyancy elements placed around it. Adequate positioning of a number of buoyancy elements provides a center of gravity of the complete vehicle 1 that is almost in the middle of the vehicle 1. All buoyancy elements or blocks are preferably positioned on or at a beam of the load-bearing structure 3.

Figure 2:
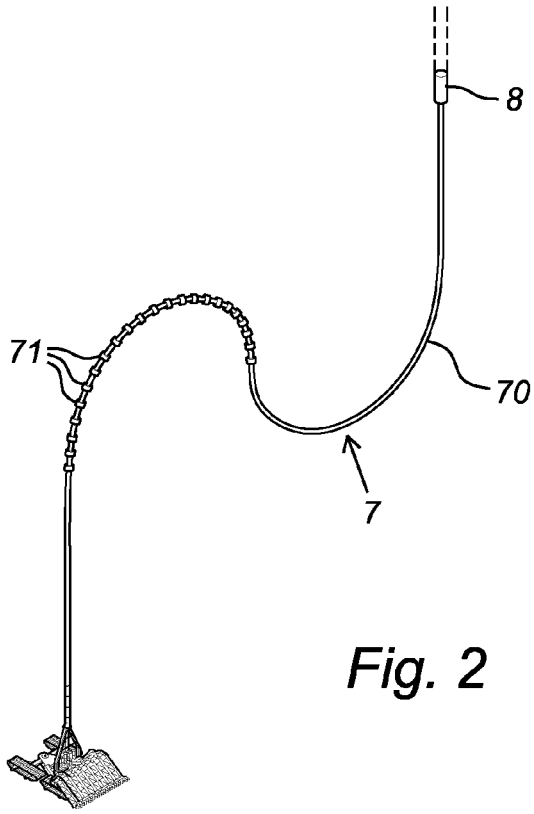
FIG. 2 is a perspective view of an assembly of the subsurface mining vehicle of FIG. 1 and a flexible riser to which it is attached.

The interconnection hose assembly 7 to which the vehicle 1 connects is schematically shown in FIG. 2. The assembly 7 comprises a flexible submarine hose 70 that is adapted to transport mineral nodules collected by the vehicle 1 to a rigid riser 8. The flexible hose 70 itself comprises a plurality of hose units of 10-15 m long for instance, interconnected by bolted flanges. When the mining vehicle 1 is not operational, the complete hose 70 is preferably stored on a reel provided on the floating vessel.

In an embodiment, a number of buoyancy elements or blocks 71 is divided over one or more hoses 70, over an equivalent length of about 50 m for instance. Each buoyancy block preferably weighs between 500 and 1000 kg, or even higher, may have a height of about 1 m and a diameter of about 1.6 m. The total length of the flexible hose 70 may be chosen within a large range and may for instance be around 150 m, and shaped like a lazy-S to decouple both vertical movements of the end of the riser 8 (due to heave for instance) as well as horizontal movements of the vehicle 1. Buoyancy blocks 71 generating an upward force in a part of the hose 70 may be used to create the S-shape.

In order to support the vehicle 1 during launching or recovery, steel lifting cables, preferably two separate lifting wires 72, are attached to the vehicle 1 to create sufficient longitudinal strength and provide lifting capacity. The steel lifting wires 72 are running along the hose 70 and are designed to be slightly shorter than the hose 70 itself, to ensure that they take most of the longitudinal stresses. The steel wires 72 are preferably not fixed to the hose 70, but are bundled with the hose 70 into a package. Hose clamps 73 or buoyancy blocks 71 take care of the bundling. The steel wires 72 are at one end connected to a top flange of the interconnection hose 70, the flange being suitable to transfer the large forces.

An umbilical wire is provided along the interconnection hose 70 to provide power and transmit signals between a floating vessel and electronic equipment installed on the vehicle 1. It is conveniently part of the package and held by the clamps 73. The required power is generally generated on the floating mining vessel and conducted through the umbilical wire to the vehicle. Moreover, fibre optic elements (for PLC's) and wires for survey equipment (submerged cameras, sensors, lighting . . . ) may also be included in the umbilical wire.

A flange or coupling is also provided on the lower end of the riser 8, to which the interconnection hose assembly 70 may be connected. A waterproof junction of umbilicals is also provided for connecting the relatively short umbilical wire of the interconnecting hose assembly 70 to the relatively long (for instance 2000-5000 m) umbilical wire that is attached to the riser string 8 and leads to the vessel.

Figure 3:
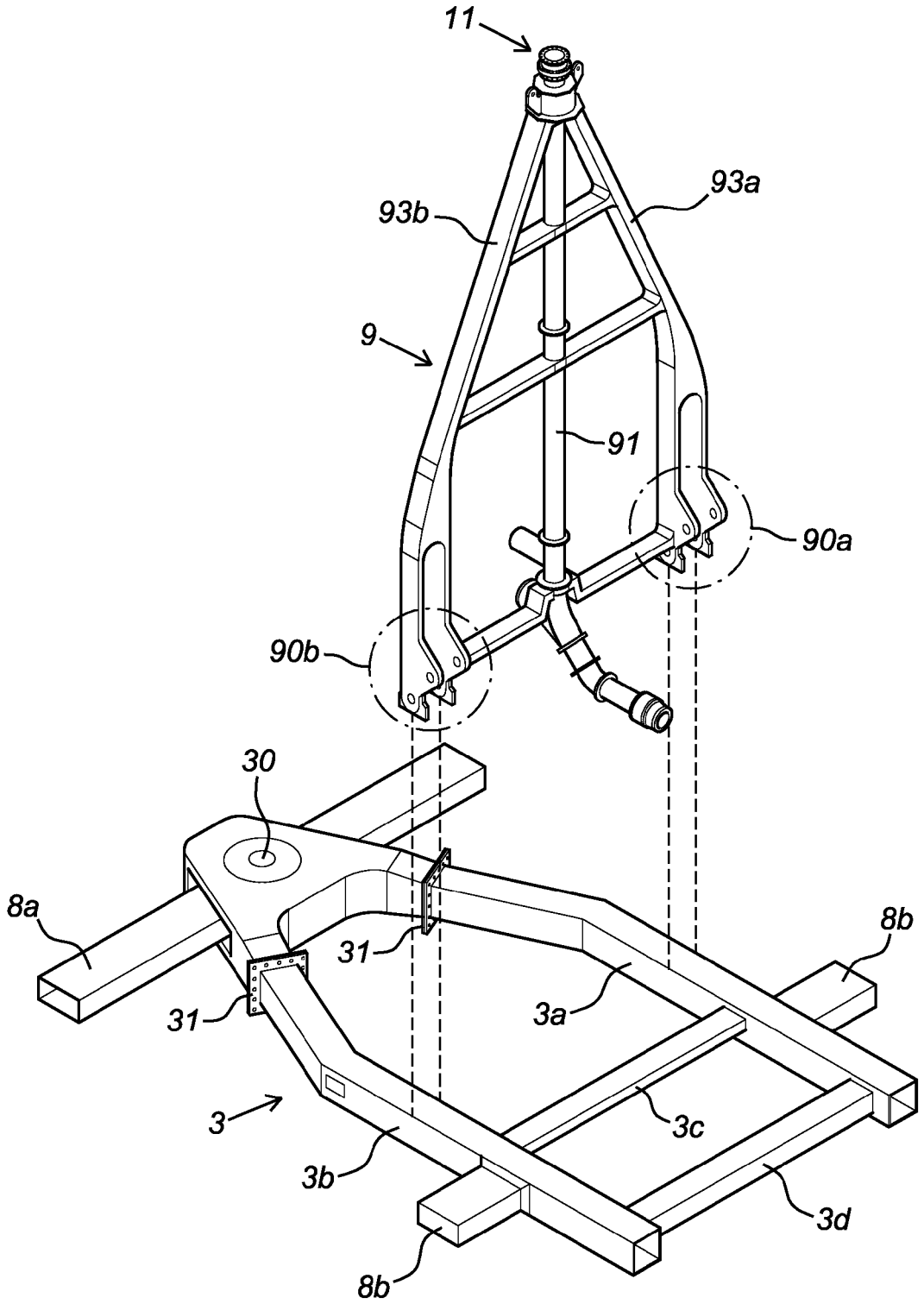
FIG. 3 is a perspective view of a vehicle showing the load-bearing structure and the lifting frame in disconnected state in accordance with an embodiment of the invention.

A shown in FIG. 3 (exploded view), steel box beam elements out of high tensile steel (e.g. RQT701) are used in an embodiment to build up a substantially planar load-bearing structure 3 of the mining vehicle 1. Alternatively the structural elements could be fabricated out of carbon fibre reinforced composites. The load-bearing structure 3 has a fork-like shape with two longitudinal beams (3*a*, 3*b*) that join in a root of the fork-shaped frame, and two transversal beams (3*c*, 3*d*) running in between and rigidly connected to the longitudinal beams (3*a*, 3*b*). The transversal beams (3*c*, 3*d*) carry the collector 2.

The load-bearing structure 3 further carries transverse beams (8*a*, 8*b*) to which aft and fore track assemblies 4 can be mounted respectively. The transverse beam 8*a* at the back of the vehicle 1 is pivotable around pivot 30 that is incorporated in the root of the fork-shaped frame. Pivot part 30 at the back of the vehicle 1 is connected by flanges 31 to the load-bearing structure, which offers a relatively easy exchange of components in case of failure or damage.

The lifting frame 9 is a steel structure that is connected to the main load bearing structure 3 via two hinge connections (90*a*, 90*b*). While deploying or recovering the vehicle 1, it will be suspended from the lifting frame 9. The flexible hose 70 and steel cable 72 assembly that interconnects the riser 8 with the vehicle 1 is thereto connected to the lifting frame 9. The lifting frame 9 in the embodiment shown guides piping 91 that connects the flexible hose 70 to the nodule collector 2.

Figure 7A:
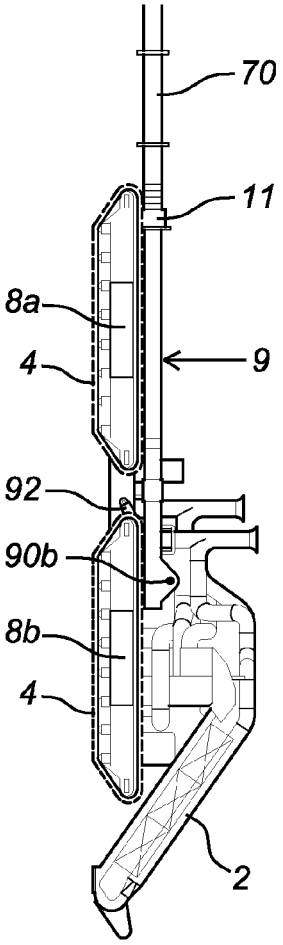
FIGS. 7A, 7B and 7C are transverse views of a vehicle in accordance with an embodiment of the invention in different angular positions.
Figure 7B:
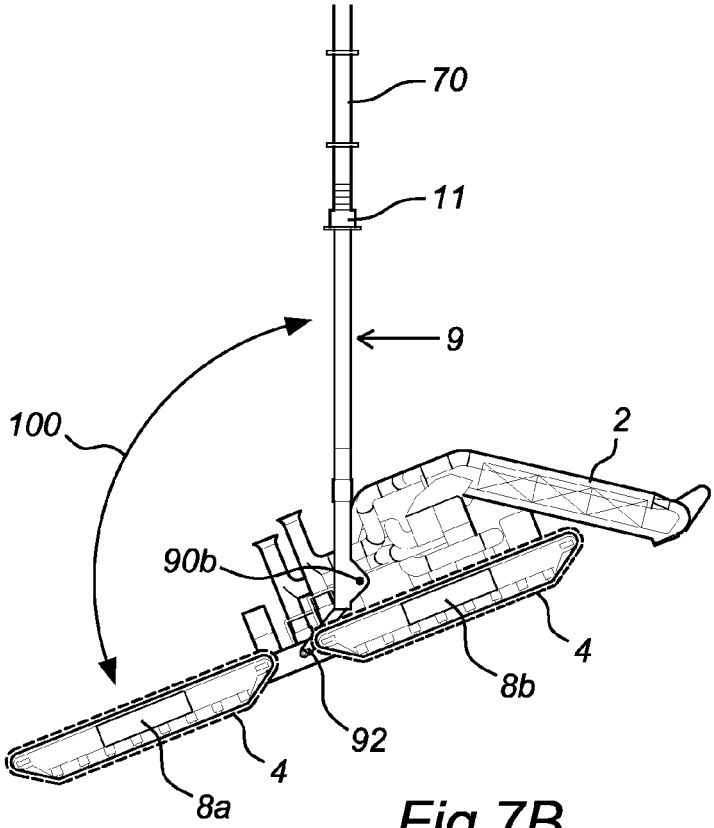
Figure 7C:
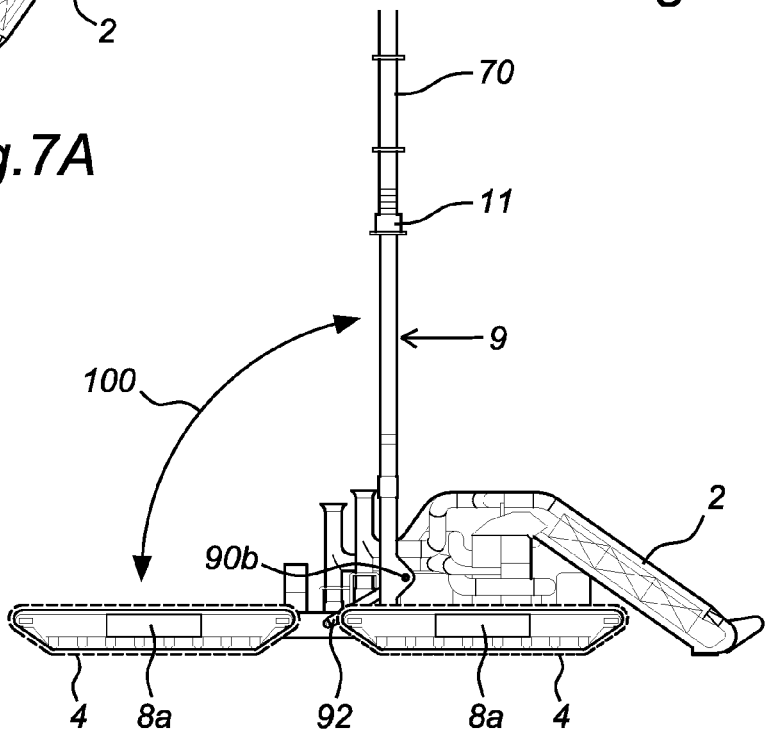

While on deck or during launch and recovery, the lifting frame 9 preferably extends parallel to the substantially planar main load-bearing chassis 3 (FIG. 7A). When the vehicle 1 is relatively close to the seafloor 5, two hydraulic cylinders 92 (see FIG. 1) in a preferred embodiment lift the frame 9 to an angle 100 of up to 105° C. for instance (FIG. 7B), such that the vehicle lands on its rear part on the seafloor 5. After landing on the seafloor 5, the frame 9 is preferably kept upright at an angle 100 of about 90° C. to the main chassis 3 (FIG. 7C).

Figure 4:
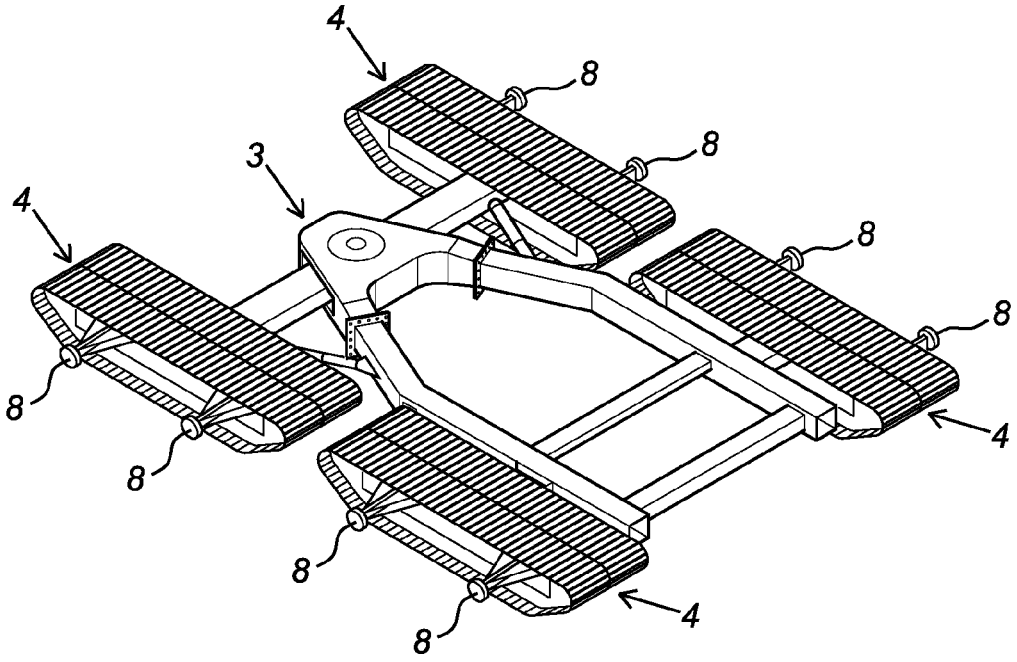
FIG. 4 is a perspective view of the load-bearing structure provided with propelling means of the vehicle of FIG. 1.
Figure 5:
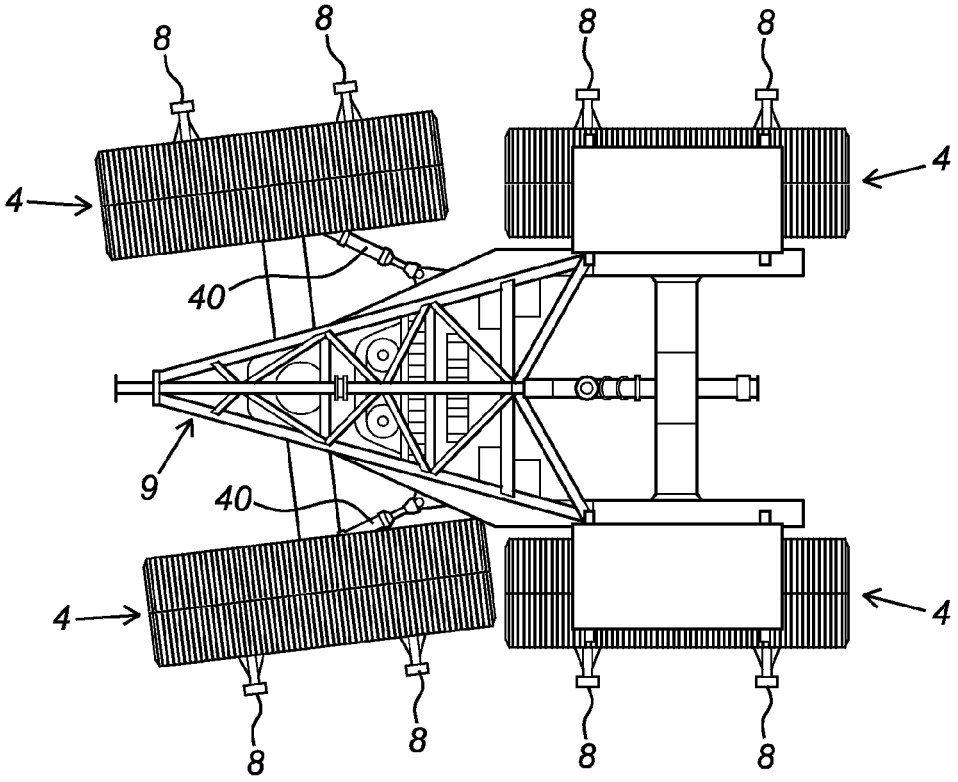
FIG. 5 is a top view of the load-bearing structure provided with propelling means and lifting frame of the vehicle of FIG. 1.

Referring to FIG. 4, suitable propelling means comprise an undercarriage provided with four separate track drives 4, which are preferably independently speed controlled. As shown in FIG. 5, such propelling means 4 offer improved manoeuvrability and higher tractive effort compared to conventional track systems. A number of independent tracks 4 may also offer advantages in case of inhomogeneous soils. A benefit of the propelling means of the present embodiment is that its four independent tracks 4 allow to use a steering mechanism, thereby avoiding additional soil disturbance. A pivot point at the back of the vehicle 1 (see FIG. 5) allows for smooth steering and minimizes disturbance of the soft seafloor. A turning radius of about 160 m and less may be achieved. In the embodiment shown, the articulation is actuated by two hydraulic cylinders 40, that are equipped with an internal spring in order to automatically reposition the steering beam to the center if a mechanical failure would occur. The pivot point is located at the back rather than in the middle of the vehicle, as it simplifies the vehicle lay-out, and has no adverse consequences on steering. The steering capacity of the vehicle is sufficient because the inertia of the vessel and riser do not allow for fast direction changes and the vehicle will typically run in long straight lanes. A steady state turn may be performed by imposing a speed difference on the left and right side of the undercarriage. Due to the long rectangular shape of the vehicle, high lateral forces may be created on the track chain and a bulldozer effect may occur.

Figure 6:
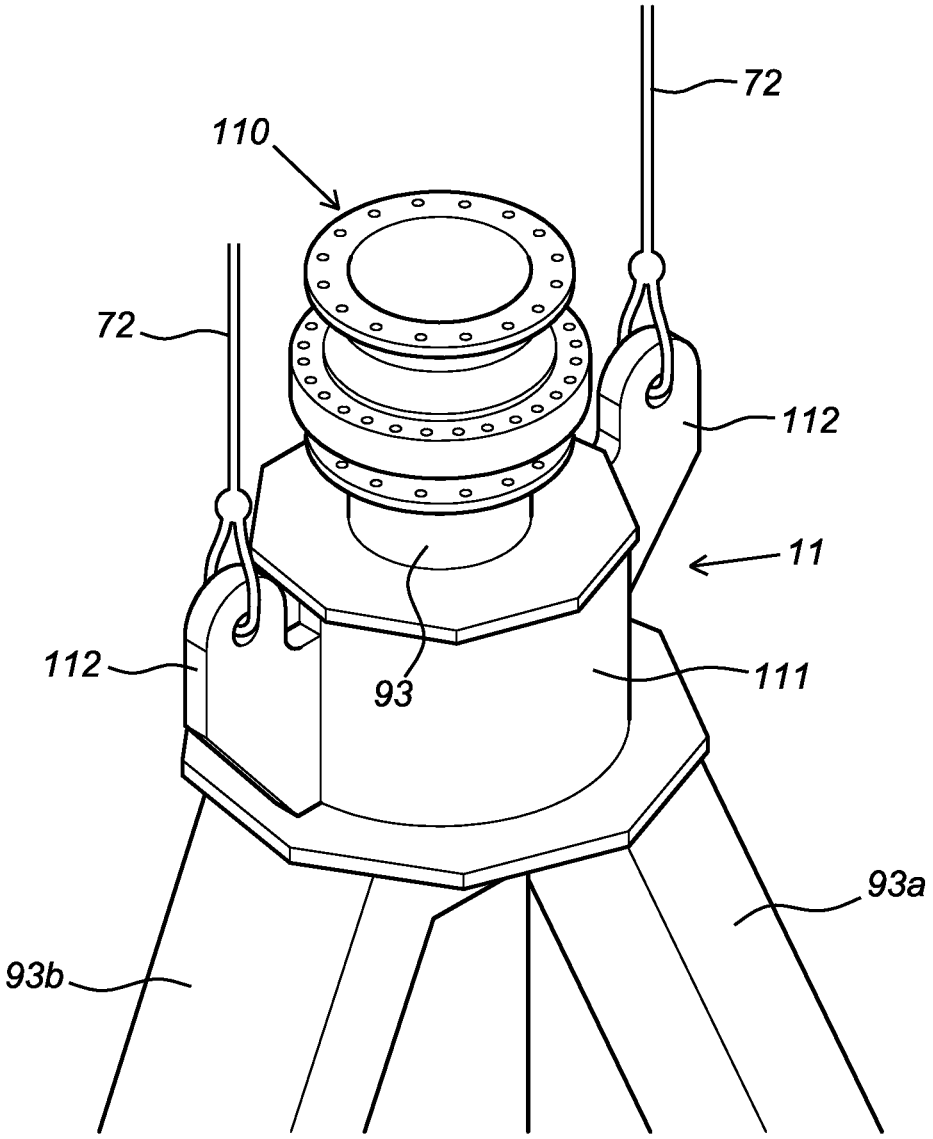

With reference to FIG. 6, a top end of the lifting frame 9 in a preferred embodiment comprises a connection 11 comprising a turning gland 110 with a slewing ring 111 provided around it. This combination allows rotational freedom of the vehicle 1 around a substantially vertical axis 112. The turning gland 110 provides a connection between the rigid piping 91 on the lifting frame 9 and the flexible interconnection hose 70 which has full rotational freedom. The lifting frame 9 is connected to the steel wires 72 by ear pieces 112 provided on the slewing ring 111. In this way, the forces can be guided through the slewing ring 111 instead of through the turning gland 110.

The slewing ring is based on slide bearing between steel on steel or plastic on steel surfaces. The slewing ring can be mechanically coupled to the turning gland to ensure parallel rotations of both. Such an arrangement may avoid entangling of umbilical and lifting wire. The flexible hose further preferably has a flanged connection to the turning gland. In this embodiment, the total rotational freedom is limited to 270° C. due to the umbilical that runs alongside the flexible interconnection hose.

The invention is not limited to the embodiments described and represented hereinbefore and various modifications can be made thereto without passing beyond the scope of the invention.

The invention claimed is:

1. A subsurface mining vehicle for collecting mineral deposits from a sea bed at great depths and transporting said deposits to a floating vessel, comprising a load-bearing structure provided with an advancer configured for advancing the vehicle on the sea bed and with a pick-up unit for the deposits, the vehicle further comprising a connector for connecting to a deposit transporting system provided between the vehicle and the floating vessel, as well as a lifting frame that is at one end provided with a suspension connector to connect to a suspender provided between the floating vessel and the vehicle, and at another end connected to the load-bearing structure by a hinged connection, that is actuated by at least one actuator such that an angular position of the load-bearing structure relative to the lifting frame can be fixed in different angular positions while the vehicle is suspended from the suspender.

2. The subsurface mining vehicle according to claim 1, wherein the at least one actuator comprise hydraulic cylinders extending between the frame and the load-bearing structure.

3. The subsurface mining vehicle according to claim 1, wherein the lifting frame is equipped with a transporter for picked-up deposits, wherein the transporter is at one end provided with the connector and at another end connects to the pick-up device.

4. The subsurface mining vehicle according to claim 1, wherein the at least one actuator comprise hydraulic cylinders extending between the frame and the load-bearing structure.

5. The subsurface mining vehicle according to claim 1, wherein the vehicle has a center of gravity and the hinged connection is positioned such that a pivot line between the frame and the load-bearing structure runs substantially through the center of gravity when the vehicle is totally submerged.

6. The subsurface mining vehicle according to claim 1, comprising buoyancy means.

7. The subsurface mining vehicle according to claim 6, wherein the buoyancy means comprise a plurality of buoyancy elements.

8. The subsurface mining vehicle according to claim 1, wherein at least one of the load-bearing structure and the lifting frame are substantially planar.

9. The subsurface mining vehicle according to claim 8, wherein the load-bearing structure comprises a fork-shaped frame of longitudinal beam members that join in a root of the fork-shaped frame, and transverse beam members spanning the distance between the longitudinal beam members at a distance from the root of the fork-shaped frame.

10. The subsurface mining vehicle according to claim 9, wherein a transverse member is pivotally connected to the root of the fork-shaped frame.

11. The subsurface mining vehicle according to claim 1, comprising at least one propeller at each side of the vehicle.

12. The subsurface mining vehicle according to claim 11, wherein the at least one propeller comprises a track assembly.

13. The subsurface mining vehicle according to claim 1, wherein the suspension connector is adapted to allow free rotation of the vehicle when suspended from the suspender around an axis parallel to a suspender axis.

14. The subsurface mining vehicle according to claim 13, wherein the suspension connector comprises a slewing ring that is attachable to the suspender and comprises a turning gland.

15. The subsurface mining vehicle according to claim 1, wherein the vehicle has a center of gravity and the hinged connection is positioned such that a pivot line between the frame and the load-bearing structure runs substantially through the center of gravity when the vehicle is totally submerged.

16. A method for collecting mineral deposits from a sea bed at great depths and transporting said deposits to a floating vessel comprising:

providing a subsurface mining vehicle in accordance with claim 1, connecting the lifting frame of said mining vehicle to a suspension cable provided between the floating vessel and the vehicle, lowering the vehicle towards a sea bed with the load-bearing structure in a first angular position, actuating the hinged connection between the lifting frame and the load-bearing structure to fixate the load-bearing structure in a second angular position that differs from the first angular position of the load-bearing structure with respect to the lifting frame, positioning the vehicle on the sea bed, and advancing the vehicle on the sea bed to pick-up the mineral deposits, wherein the first angular position is parallel to the vertical direction.

17. The method according to claim 16, wherein the second angular position makes an angle of 90° or more with respect to the vertical direction.

18. The method according to claim 17, wherein the second angular position makes an angle of more than 90° with respect to the vertical direction, such that the vehicle contacts the sea bed first with a rear end thereof.

19. The method according to claim 16, wherein the mining vehicle is connected to a deposit transporting system provided between the vehicle and the floating vessel.

* * * * *